US006570482B2

(12) United States Patent
Brown et al.

(10) Patent No.: US 6,570,482 B2
(45) Date of Patent: May 27, 2003

(54) FUSE APPARATUS AND METHOD

(75) Inventors: Russell Brown, Loughborough (GB); Rognvald Ridley Peterson, Frome (GB); Stuart Richard Roberts, Frome (GB)

(73) Assignee: Cooper Technologies, Houston, TX (US)

( * ) Notice: Subject to any disclaimer, the term of this patent is extended or adjusted under 35 U.S.C. 154(b) by 0 days.

(21) Appl. No.: 09/801,159

(22) Filed: Mar. 7, 2001

(65) Prior Publication Data

US 2002/0008608 A1 Jan. 24, 2002

(30) Foreign Application Priority Data

Mar. 8, 2000 (GB) ..... 00301876

(51) Int. Cl.[7] ..... H01H 85/11; H01H 85/055

(52) U.S. Cl. ..... 337/160; 337/290; 337/159; 337/296

(58) Field of Search ..... 337/152, 159, 337/160, 161, 290, 292, 296; 29/623

(56) References Cited

U.S. PATENT DOCUMENTS

| | | | | | |
|---|---|---|---|---|---|
| 2,557,926 | A | | 6/1951 | Swain et al. | |
| 3,705,373 | A | * | 12/1972 | Cameron | 337/160 |
| 3,864,655 | A | * | 2/1975 | Kozacka | 337/159 |
| 4,216,457 | A | * | 8/1980 | Panaro | 337/159 |
| 4,357,588 | A | * | 11/1982 | Leach et al. | 337/160 |
| 4,635,023 | A | | 1/1987 | Oh | |
| 5,229,739 | A | | 7/1993 | Oh et al. | |
| 5,293,147 | A | | 3/1994 | Oh et al. | |
| 5,373,278 | A | | 12/1994 | Saulgeot et al. | |
| 5,528,213 | A | * | 6/1996 | Kondo et al. | 337/160 |
| 5,668,522 | A | | 9/1997 | Kondo et al. | |
| 5,748,067 | A | * | 5/1998 | Ishii et al. | 337/152 |
| 5,854,538 | A | | 12/1998 | Krummel | |
| 5,898,657 | A | | 4/1999 | Hirata et al. | |
| 6,075,434 | A | | 6/2000 | Rueckling | |
| 6,160,471 | A | * | 12/2000 | Rybka et al. | 337/273 |
| 6,163,244 | A | * | 12/2000 | Endo et al. | 337/159 |

FOREIGN PATENT DOCUMENTS

| | | | | |
|---|---|---|---|---|
| DE | 827093 | | 1/1952 | |
| DE | 198 46 349 A1 | | 2/1998 | |
| GB | 742968 | | 1/1956 | |
| GB | 1114804 a | * | 5/1968 | H01H/85/04 |
| GB | 1369227 | | 10/1974 | |

* cited by examiner

*Primary Examiner*—Anatoly Vortman
(74) *Attorney, Agent, or Firm*—Armstrong Teasdale LLP

(57) ABSTRACT

An electrical fuse includes a pair of terminal portions and a fusible link extending between the pair of terminal portions. The fusible link includes a fusing portion and a modifying portion in contact with the fusing portion. The modifying portion is formed of a material having a lower melting point than the fusing portion, and the fusible link includes a hole extending therethrough and defining an open-sided receptacle. A side of the open-sided receptacle forms one side of the fusing portion, and the modifying portion is disposed within the substantially open-sided receptacle.

10 Claims, 3 Drawing Sheets

FUSE APPARATUS AND METHOD

BACKGROUND OF THE INVENTION

This invention relates generally to electrical fuses and, in particular, to electrical fuses having a fusible link extending between a pair of terminal portions.

Known electrical fuses have taken many forms and generally comprise fuses having a fusible link extending between a pair of terminal portions. The fusible link may be provided either with notches cut in one or more sides of the fusible portion or with holes formed therethrough to create narrower and therefore weaker portions within the fusible portion.

In at least some types of fuses, the holes within the fusible links are filled with a material having a lower melting point than the parent metal of the fusing portion. As the fusible link is heated during an electrical overload, the lower melting-point material diffuses into the parent metal, thereby raising the electrical resistance of the fusible link and further increasing the electrical load on the narrow and weaker portions of the fusible link. When the load reaches a sufficient magnitude, the fusible link fails and the electrical connection is no longer maintained. The presence of the lower melting point material modifies operational characteristics of the fusible link such that the highest current it will carry indefinitely without failing or melting is reduced while its behavior at higher currents is substantially unaffected. This phenomenon is sometimes referred to as a "Metcalf effect" or "M-effect".

One disadvantage of such a fuse link construction including holes in the fusible link is that it provides two weak points in parallel with each other, i.e., one weak point on each side of the hole in the fusible link. To achieve consistent fusing performance between individual fuses, the two parallel weak points should be very accurately matched. Slight differences between the cross-sectional areas of the two weak points will lead to an undesirable imbalance in the current flowing through each of the weak points, which further results in a temperature imbalance between the two weak points. Since, for a given fuse current rating the cross-sectional area of each of the parallel weak points will account for roughly one half that of the fuse current rating, accurate and repeatable fuse element manufacture is difficult, particularly for fuses of low current rating.

BRIEF SUMMARY OF THE INVENTION

In an exemplary embodiment of the invention an electrical fuse includes a pair of terminal portions and a fusible link extending between the pair of terminal portions. The fusible link includes a fusing portion and a modifying portion in contact with the fusing portion. The modifying portion is formed of a material having a lower melting point than the fusing portion, and the fusible link includes a hole extending therethrough and defining an open-sided receptacle. A side of the open-sided receptacle forms one side of the fusing portion, and the modifying portion is disposed within the substantially open-sided receptacle.

A method of manufacturing the electrical fuse includes the steps of forming a hole extending through the fusible link to define an open sided receptacle, forming the modifying portion within the substantially open-sided receptacle by disposing a body of lower melting point material therein, and melting and reflowing the body of lower melting point material into intimate contact with the side of the open-sided receptacle.

A fuse having a single reliable fusible portion is therefore provided that is particularly advantageous for low current rating fuse applications wherein conventional fuses have been disadvantaged. Using relatively simply construction techniques, accurate and repeatable low current fuses may be produced.

DETAILED DESCRIPTION OF THE INVENTION

Figure 1:
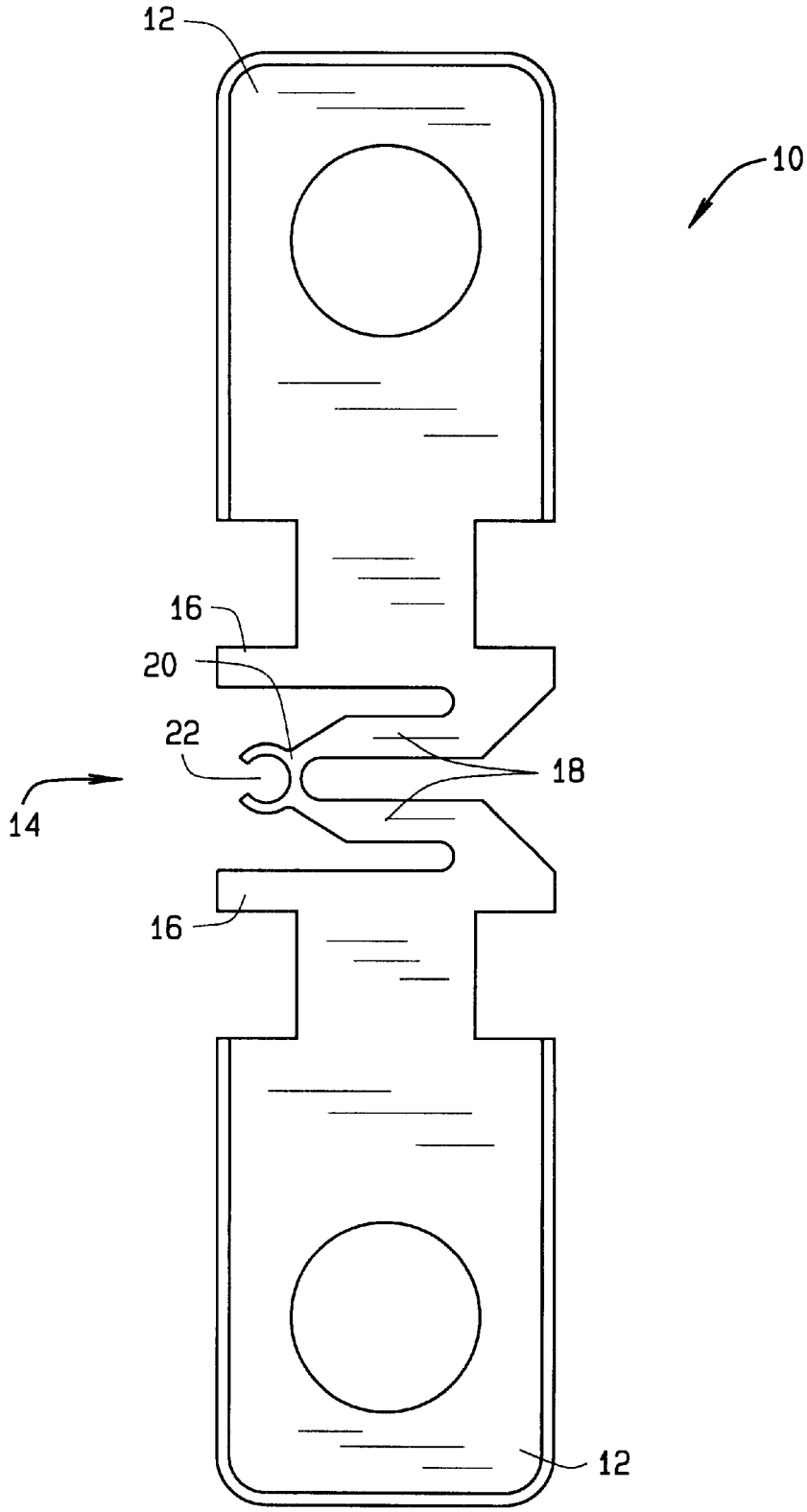
FIG. 1 is a partial top plan view of a first embodiment of an electrical fuse at a first stage of manufacture.

FIG. 1 illustrates an electrical fuse 10 at a first stage of manufacture. Fuse 10 includes first and second terminal portions 12 at each end and an M-shaped fusible link 14 extending therebetween. When first and second terminal portions 12 are connected to line-side and load-side equipment, (not shown) respectively, an electrical circuit is completed through fuse element 10 between terminals 12, and hence through fusible link 14. As fusible link 14 has a reduced cross sectional area relative to terminals 12, fusible link 14 is heated to a higher temperature by current flowing therethrough than an operating temperature of fuse terminals 12. When current flowing through fuse 10 reaches a predetermined threshold level, sometimes referred to as a fault, overcurrent, or overload condition, fusible link 14 melts, disintegrates or otherwise fails and breaks or opens the electrical circuit. Load side electrical circuits and equipment (not shown) are therefore isolated from malfunctioning power supplies, systems or circuits (not shown).

Terminals 12 are generally longitudinally aligned with one another about a common axis and are located on either side of fusible link 14 in an inversely symmetric manner, i.e., a mirror image, about fusible link 14. Each terminal 12 is connected to a respective leg 16 of M-shaped fusible link 14. Arms 18 extend from fusible link legs 16 in substantially parallel fashion and are joined by a fusing portion 20 having a reduced cross sectional area relative to both fusible link legs 16 and fusible link arms 18. An open-sided, cup-shaped receptacle 22, part of which forms one side of fusing portion 20, extends from fusing portion 20 on either end of fusing portion 20. Receptacle 22 is provided to hold an M-effect alloy slug (not shown in FIG. 1) for forming a "modifying portion" of fusible link 14 in which M-effect material diffuses into the narrow fusing portion 20, causing fusing portion 20 to melt and break an electrical connection through fuse 10 during electrical overload conditions.

In one embodiment, cup shaped receptacle 22 is formed as an incomplete annulus such that there is only a single join between respective arms 18 that forms fusing portion 20. A single weak point, or weak spot, in fusible link 14, and more specifically, fusing portion 20, is therefore provided for increased accuracy and repeatability of fuses 10 for low current applications. The disadvantages of conventional fuses including multiple fuse weak points connected in parallel, and more specifically undesirable imbalance of current flow between the weak points for fuses of low current ratings, is therefore avoided. Fuse performance is thereby increased with a construction of simplified manufacturability.

In one embodiment, fuse 10 is integrally formed from a known conductive material, hereinafter referred to as a parent material, such as copper in an exemplary embodiment. Open-sided receptacle 22 is formed thereafter by punching a hole in fusible link 14 through the parent material such that the hole breaks through an edge of the parent metal in fusible link 14, thus creating only one electrical weak point in fusible link 14. It is contemplated, however, that in alternative embodiments, open receptacle 22 could be formed integrally with fusible link 14 according to other methods and techniques known in the art, such as, for example, integrally molding receptacle 22 into fusible link 14, or via a stamping or punching operation simultaneously forming fusible link 14 and receptacle 22.

Figure 2:
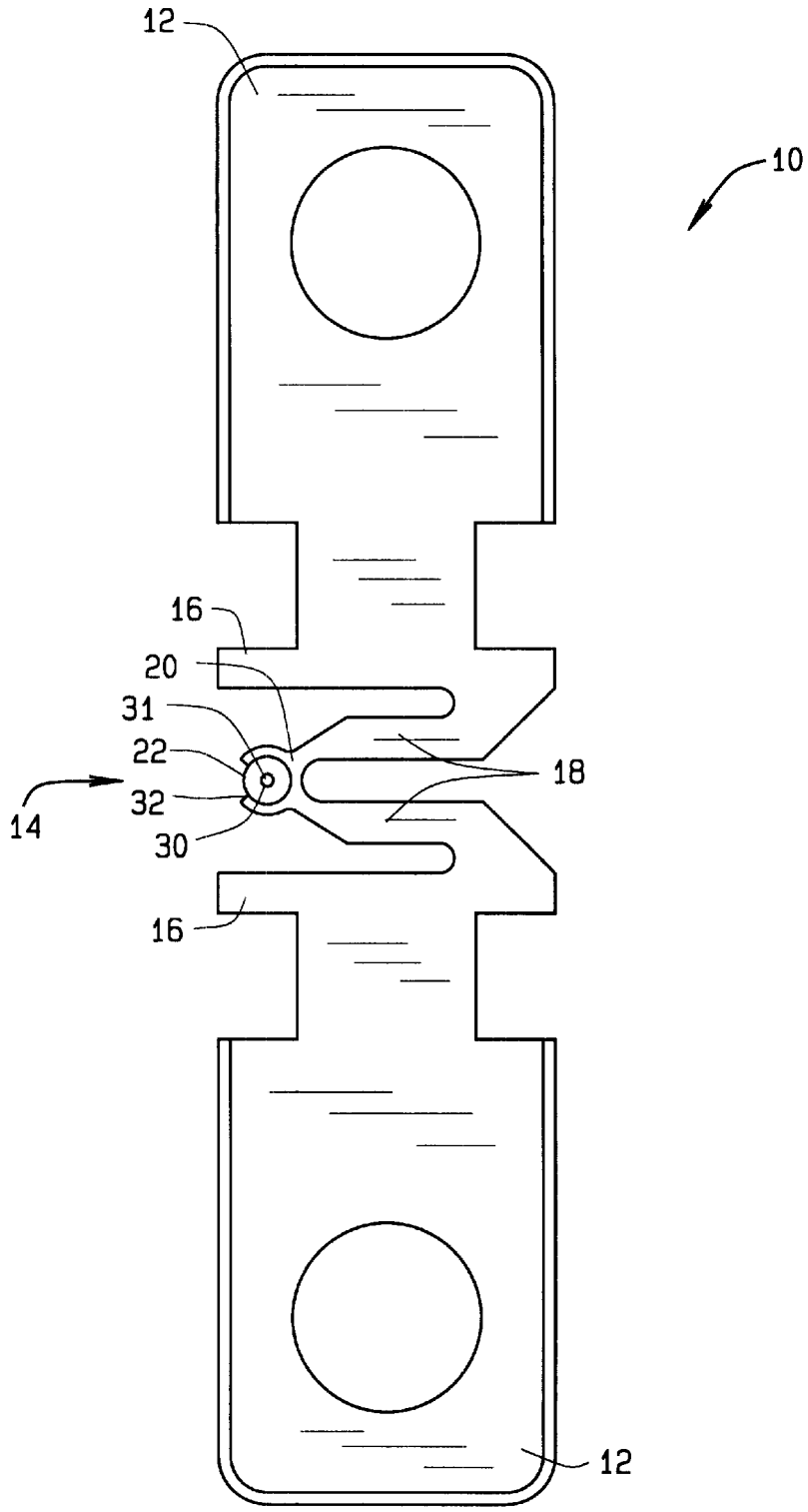
FIG. 2 is top plan view of the fuse shown in FIG. 1 at a second stage of manufacture.

FIG. 2 illustrates fuse 10 at a second stage of manufacture wherein a body of low melting point alloy 30, such as an M-effect alloy or an alloy having a lower melting point than the parent material of fusible link 14, is disposed in open sided receptacle 22.

In an exemplary embodiment, body 30 of lower melting point material is a short slug of M-effect alloy. In a further embodiment, the slug is preferably between 2 and 4 mm in length. The slug may, for example, be cut from a continuous reel of alloy material, the material having a circular cross section complementary to the opening of cup-shaped receptacle 22. In a further embodiment, body 30 of the low melting point alloy is "cored", i.e. soldering flux 31 is dispersed along its length in a coaxial core.

One end of alloy body 30 is formed with a radially extending portion 32 such that, during insertion of body 30 into receptacle 22, radially extending portion 32 prevents body 30 from falling through open-sided receptacle 22 prior to the alloy being reflowed. As used herein, radially extending portion 32 refers to any portion of an outer circumference of body 30 that rests upon an outer surface of open-sided receptacle 22 when body 30 is disposed into open receptacle 22. Therefore, in different embodiments, radially extending portions 32 includes, for example, a continuously extending overhang or rim having a dimension greater than a dimension of the opening of receptacle 22, or one or more discrete projections having a greater radial dimension than an opening of receptacle 22 and therefore maintains body 30 in position relative to receptacle 22.

Once positioned in receptacle 22, M-effect alloy body 30 is heated, melted, and reflowed to ensure reliable fuse operation over the entire working life of the fuse link. When reflowed, body 30 forms a modifying portion in fusible link 14 in intimate contact with fusing portion 20 and the walls of open-sided receptacle 22. The presence of the lower melting point material of body 30 modifies operational characteristics of fusible link 14 such that the highest current it will carry indefinitely without failing or melting is reduced while its behavior at higher currents is substantially unaffected. Further, the use of such an alloy body 30 does not appreciably alter the electrical resistance of fusible portion 20, i.e., the weak point, since the electrical resistivity of the alloy is significantly higher than that of the parent metal.

In a further embodiment, fusible link 14 may be covered or otherwise enclosed by a protective housing (not shown) fabricated from a non-conductive material, including but not limited to engineered thermoplastic materials capable of withstanding operating temperatures of fuse 10 and arc conditions created as fuse 10 opens in operation.

In one embodiment, low melting point alloy body 30 consists of 96% tin and 4% silver, sometimes referred to as "96S". Alternatively, other compositions of these or differing materials may be used within the scope of the present invention. Similarly, while the parent material of fusible link 14 is copper in one embodiment, it is understood that other suitable electrically conductive materials may be used in alternative embodiments.

A fuse 10 having a single reliable fusible portion 20 is therefore provided that is particularly advantageous for low current rating fuse applications wherein conventional fuses have been disadvantaged. Using relatively simply construction techniques, accurate and repeatable low current fuses may be produced.

While the present invention has been described and illustrated in the context of M-shaped fusible link 14 with a cup-shaped open receptacle 22, it is contemplated that the benefits of the invention could be likewise obtained using a variety of differently configured fusible links and fusible link receptacles with appropriate modification to the alloy body to maintain the alloy body in position prior to reflowing the material of the alloy body. In other words, a non-circular receptacle 22 could be employed with a non-circular alloy body 30 in fuse links of other than an M-shaped configuration while achieving some or all of the advantages of the instant invention. It is therefore understood that the foregoing illustration is for illustrative purposes only rather than by way of limitation.

Figure 3:
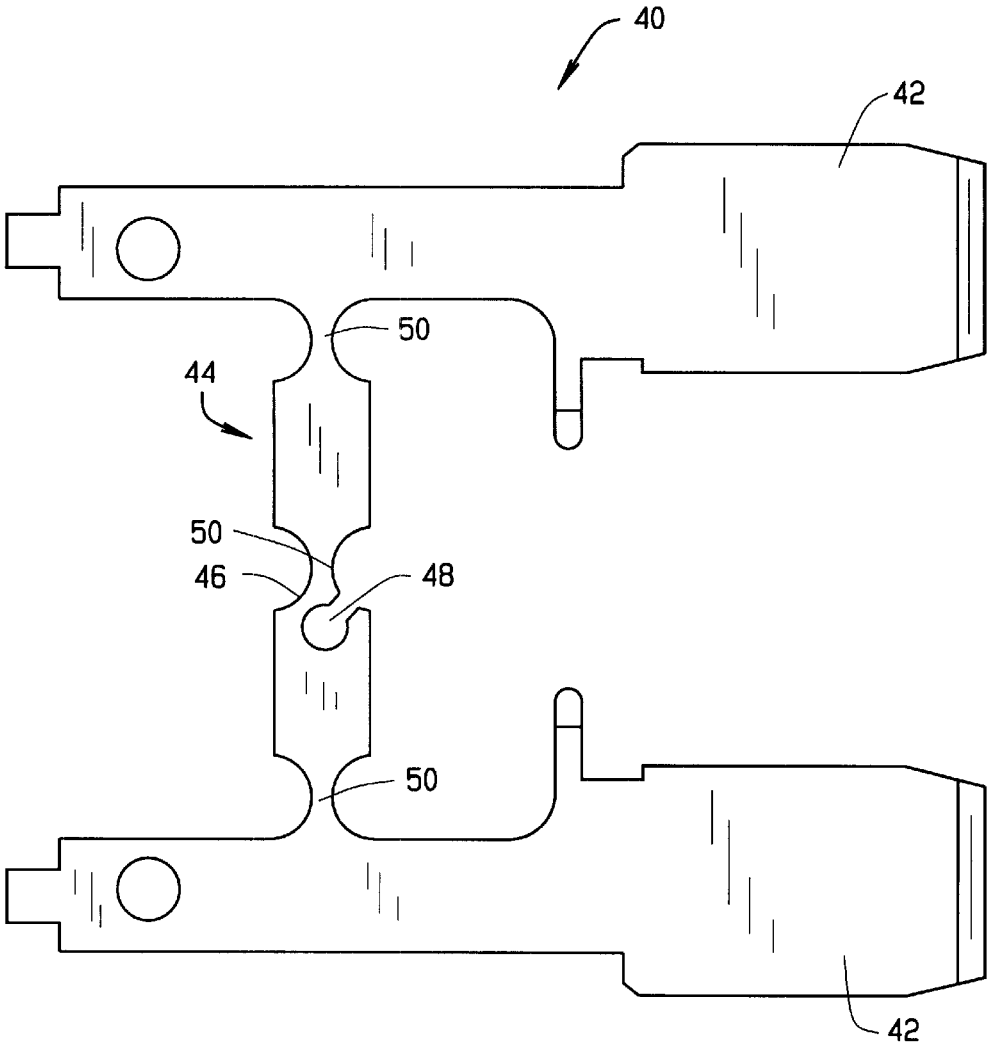
FIG. 3 is a top plan view of a second embodiment of an electrical fuse at a first stage of manufacture.

FIG. 3 illustrates a second embodiment of an alternative electrical fuse element 40 at a first stage of manufacture. Fuse element 40 includes first and second terminals 42 extending substantially parallel to one another, and a fusible link 44 extending transversely therebetween. Fusible link 44 includes a fusing portion 46 partly formed by an open-sided receptacle 48. In other words, one side of receptacle 48 forms one side of fusing portion 46. Open-sided receptacle 48 is disposed adjacent one of a plurality of narrowed sections or weak spots 50 of fusible link 44. In an alternative embodiment, more than one receptacle 48 is employed in series in fuse link 44.

Receptacle 48 is dimensioned to receive a low melting point alloy body, such as body 30 described above in relation to FIG. 2, in a second stage of manufacture (not shown). Except as otherwise noted, assembly and operation of fuse 40 is substantially similar to that described above in relation to FIGS. 1 and 2.

In a further embodiment, fusible link 44 may be covered or otherwise enclosed by a protective housing (not shown)

fabricated from a non-conductive material, including but not limited to engineered thermoplastic materials capable of withstanding operating temperatures of fuse 40 and arc conditions created as fuse 40 opens in operation.

While the invention has been described in terms of various specific embodiments, those skilled in the art will recognize that the invention can be practiced with modification within the spirit and scope of the claims.

What is claimed is:

1. An electrical fuse comprising:

a pair of terminal portions;

a fusible link extending between said pair of terminal portions, said fusible link comprising a substantially planar fusing portion and a modifying portion in contact with a surface of said fusing portion, said modifying portion being formed of a material having a lower melting point than said fusing portion; and said fusible link comprising a hole extending therethrough and defining an open-sided receptacle, said open-sided receptacle comprising a side of which forms one side of said fusing portion, said modifying portion disposed within said substantially open-sided receptacle and diffused into said fusing portion.

2. An electrical fuse in accordance with claim 1, wherein said fusible link comprises a plurality of open sided receptacles, thereby forming a plurality of fusing portions in series.

3. An electrical fuse in accordance with claim 1 wherein said modifying portion comprises an M-effect alloy.

4. An electrical fuse in accordance with claim 3 wherein said M-effect alloy comprises 96% tin and 4% silver.

5. An electrical fuse in accordance with claim 3 wherein said M-effect alloy comprises a soldering flux dispersed along a length of said M-effect alloy within a coaxial core.

6. An electrical fuse in accordance with claim 1 wherein said modifying portion comprises a slug of M-effect alloy with a circular cross section.

7. An electrical fuse in accordance with claim 6 wherein said slug of M-effect alloy is between 2 mm and 4 mm in length.

8. An electrical fuse in accordance with claim 6 wherein said M-effect alloy comprises a radially extending portion such that, during insertion of said slug, said radially extending portion is configured to prevent said slug from falling through said open-sided receptacle.

9. An electrical fuse in accordance with claim 1 wherein said fusible link is fabricated from copper.

10. An electrical fuse in accordance with claim 1 wherein said hole in said fusible link is located such that said hole breaks through an edge of said fusing portion of said fusible link.

* * * * *